US007262707B2

(12) United States Patent
Kaoh

(10) Patent No.: US 7,262,707 B2
(45) Date of Patent: Aug. 28, 2007

(54) MESSAGE SIGN ALERT DEVICE AND METHOD

(75) Inventor: Andy K. F. Kaoh, Santa Ana, CA (US)

(73) Assignee: Pro-Lite, Inc., Costa Mesa, CA (US)

( * ) Notice: Subject to any disclaimer, the term of this patent is extended or adjusted under 35 U.S.C. 154(b) by 151 days.

(21) Appl. No.: 11/057,609

(22) Filed: Feb. 14, 2005

(65) Prior Publication Data

US 2006/0192684 A1 Aug. 31, 2006

(51) Int. Cl.
*G08B 5/00* (2006.01)

(52) U.S. Cl. ..... 340/815.4; 340/326; 340/331; 340/332; 340/539.1

(58) Field of Classification Search ..... 340/815.4, 340/326, 331, 332, 539.1
See application file for complete search history.

(56) References Cited

U.S. PATENT DOCUMENTS 6,243,685 B1 * 6/2001 Welch et al. ..... 704/276

* cited by examiner

*Primary Examiner*—Daryl C Pope

(57) ABSTRACT

A message sign alert device including a housing having a planar message display window and a first visual alert window positioned on a periphery of the planar message display window. Within the housing are a message display section, a first visual alert section, and a control unit that operates the first visual alert section and the message display section for providing a visual attraction to the display of a message on the message display section. A planar display unit in the message display section includes a plurality of light emitting message elements and projects through the planar message display window at a substantially normal angle to the planar message display window. The first visual alert section has at least one light emitting element positioned adjacent to the first visual alert window for projecting through the first visual alert window at an oblique angle relative to the planar message display window.

21 Claims, 8 Drawing Sheets

MESSAGE SIGN ALERT DEVICE AND METHOD

FIELD OF THE INVENTION

This invention is related to an alert device and more particularly to a visual and audible alert device integrated with an electronic message sign.

DESCRIPTION OF RELATED ART

Electronic message signs of various types are known in the art. Typically, electronic message signs simply display various indicia corresponding to information such as alphanumerical characters. However, traditional electronic message signs are easy to ignore, and on various occasions it may be desirable to attract attention to the electronic message sign. Hence, there remains a need for an alert device to attract the attention of individuals to the electronic message sign.

SUMMARY OF THE INVENTION

The present invention, as defined in the claims, provides a visual alert section for asserting a visual alert to an individual in proximity to the message sign alert device either prior to or during the display of a message corresponding to the visual alert. Further, the present invention provides an audible alert section for asserting an audible alert to a bystander. Both the visual alert and the audible alert are intended to attract attention to the electronic message sign prior to or concurrent with the display of a message.

In one embodiment, a housing includes a planar message display window aligned within a first plane and a first visual alert window disposed on a periphery of the planar message display window. A message display section includes a planar display unit having a plurality of light emitting message elements for display message information. The planar display unit is positioned within the housing adjacent to the planar message display window to enable light projected from the message elements to pass through the planar message display window.

The light from the message elements is projected at an angle that is substantially normal to the planar message display window that is parallel to a first plane. A first visual alert section has at least one light emitting first visual alert element that is positioned within the housing and adjacent to the first visual alert window to enable the first visual alert element to project light through the first visual alert window. The light from the first visual alert window is projected at an oblique angle relative to the planar message display window.

A control unit operates the message display section and the first visual alert section causing the first visual alert section to emit a first visual alert signal in order to provide a visual attraction to the display of a message on the message display section. The first visual alert signal is light emitted in a predetermined pattern. The predetermined pattern can be a series of lighting (turning on) and delighting (turning off) the light emitting elements.

In another embodiment, the message sign alert device includes a housing with a planar message display window aligned within a first plane, a first visual alert window disposed on a periphery of the planar message display window, a second visual alert window disposed on the periphery of the planar message display window, and an audible alert section. A message display section includes a planar display unit having a plurality of light emitting message elements for display message information.

The planar display unit is positioned within the housing adjacent to the planar message display window to enable light projected from the message elements to pass through the planar message display window. The light from the message elements is projected at an angle that is substantially normal to the planar message display window that is parallel to a first plane.

A first visual alert section has at least one light emitting first visual alert element that is positioned with the housing and adjacent to the first visual alert window to enable the first visual alert element to project light through the first visual alert window. The light from the first visual alert window is projected at an oblique angle relative to the planar message display window.

A second visual alert section has at least one light emitting second visual alert element that is positioned within the housing and adjacent to the second visual alert window to enable the second visual alert element to project light through the second visual alert window. The light from the second visual alert window is projected at an oblique angle relative to the planar message display window.

An audible alert section that has at least one sound emitting element is positioned within the housing. A control unit operates the message display section, the first visual alert section, the second visual alert section, and the audible alert section in order to provide a visual and audible attraction to the display of a message on the message display section.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
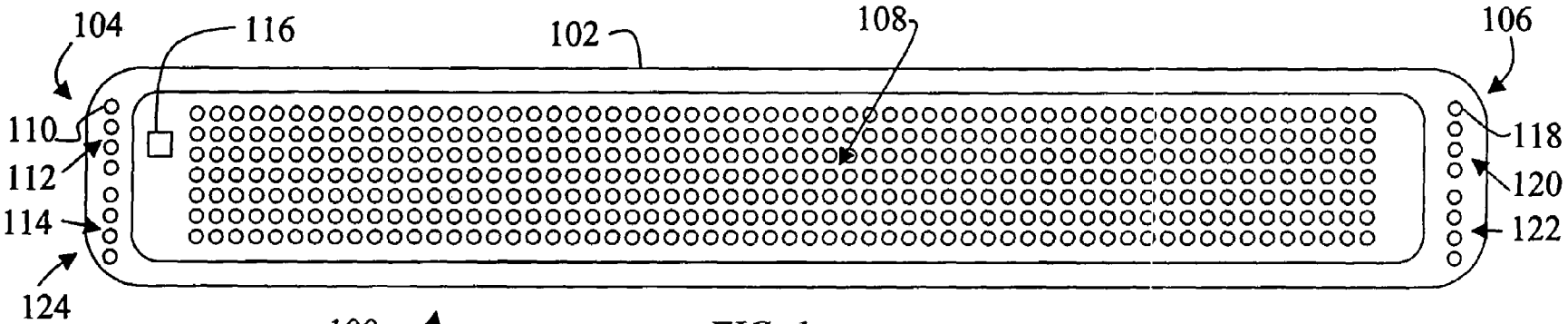
FIG. 1 is a front-view of the message sign alert device in accordance with an embodiment of the present invention.

In reference to FIG. 1, in one embodiment, a message sign alert device 100 includes a uniform, unitary housing 102. Alternatively, some or all of the housing 102 may be composed of individual attached components in the unified housing 102 that are assembled together. The housing 102 preferably includes two visual alert sections (104, 106) for providing a visual alert to an individual in proximity to the message sign alert device, a bystander or an individual passing near the message sign alert device, regarding a current or impending message reproduced on a message display section 108.

The first visual alert section 104 includes at least one light emitting alert element 110, and preferably includes a plurality of light emitting alert elements that can be arranged in one or more groups. In one embodiment, a first group 112 and the second group 114 each contain a plurality of light emitting alert elements, such as light emitting diodes (LED), for example.

Similarly, the second visual alert section 106 includes at least one light emitting alert element 118, and preferably includes a plurality of light emitting alert elements that can be arranged in one or more groups. A first group 120 and the second group 122 each may contain a plurality of light emitting alert elements. The second visual alert section 106 is preferably positioned on an opposite edge of the periphery of the message display section 108, as shown in FIG. 1.

Alternatively, the second visual alert section 106 can be placed on the same edge as the first visual alert section 104. In the case where the intended audience of individuals are located typically to either side of the message sign alert device 100, such as in a hallway, the first visual alert section 104 and the second visual alert section 106 are located on opposite lateral peripheral ends of the housing 102 as shown in FIG. 1. Where the intended audience of individuals are located typically above and below the message sign alert device 100, such as passengers ascending or descending on an escalator, the first visual alert section 104 and the second visual alert section 106 are located on opposite vertical peripheral ends of the housing 102.

In yet another alternative, visual alert sections may be located on each peripheral edge of the message display section 108 and may be activated in a predetermined pattern. Although preferably the visual alert sections (104, 106) are activated together, in an alternative embodiment the visual alert sections may be activated alternately in a "ping-pong" fashion. Similarly, the light emitting alert elements (110, 118) within a group (112, 114, 120, 122) may be individually activated in a sequential pattern to produce a more subtle attraction effect.

Oriented on the top face of the message display section 108 is a sensor section 116. The sensor section 116 preferably includes an ambient light sensor and a remote control receiver sensor. The ambient light sensor is used in selectively dimming or brightening the emitted light intensity based on the ambient light level. A terminal interface section 124 allows connection to a terminal for programming the message sign alert device as will be discussed below.

The remote control receiver sensor is used for receiving user commands generated from a remote command unit such as a hand-held remote control, described below. The hand-held remote control can be used to program the message sign alert device 100 by sending configuration data and message data. The message data can be represented as indicia on the message display section 108. The configuration data determines how to display particular messages as well as when to provide a visual and audible alert forming a visible and audible attraction to the display of a message on the message display section.

The alert may be used to draw the attention of an individual to the message sign alert device 100 based on the alert. For example, the configuration data associated with a particular message may include a command to flash the indicia of the message a predetermined number of times. As another example, the configuration data associated with a particular message may cause the indicia of the message to scroll in a right-to-left manner to facilitate reading a longer text message in a left-to-right manner.

Configuration data can include an alert command to signal an alert through the visual alert sections or the audible alert section. This alert command can include a severity level to indicate the urgency of the alert. In one embodiment, three alert levels are implemented: Beep-Only, Attention, and Code-Blue. If the Beep-only alert is selected, the message sign alert device 100 will assert a beeping sound from the audible alert section 206, alternately sound and silence, ten times for approximately five seconds at a predetermined pitch, for example. After the Beep-Only alert is issued, display of the alerted message indicia follows. Alternatively, the alert may be issued along with the display of the alerted message indicia.

If the Attention alert is selected, the message sign alert device 100 will assert a beeping sound, alternate sounding and silence, ten times for approximately five seconds at a predetermined pitch, for example. Also, during the Attention alert, the message sign alert device 100 will cause the visual alert sections to flash ten times for approximately five seconds. The sounding may be synchronized with the flashing so that both light and sound coincide. Alternatively, the visual and audible alert may be asynchronous, not lighting and sounding simultaneously. Similarly, after the Attention alert is issued, that is broadcast by the message sign alert device 100, display of the alerted message indicia follows.

If the Code-Blue alert is selected, the message sign alert device 100 will assert a beeping sound, alternate sounding and silence, ten times for approximately three seconds at a predetermined pitch, for example. Also, during the Code-Blue alert, the message sign alert device 100 will cause the visual alert sections to flash ten times for approximately three seconds. Similarly, after the Code-Blue alert is issued, that is broadcast by the message sign alert device 100, display of the alerted message indicia follows. Other patterns of sound and light emission may be used.

Figure 2:
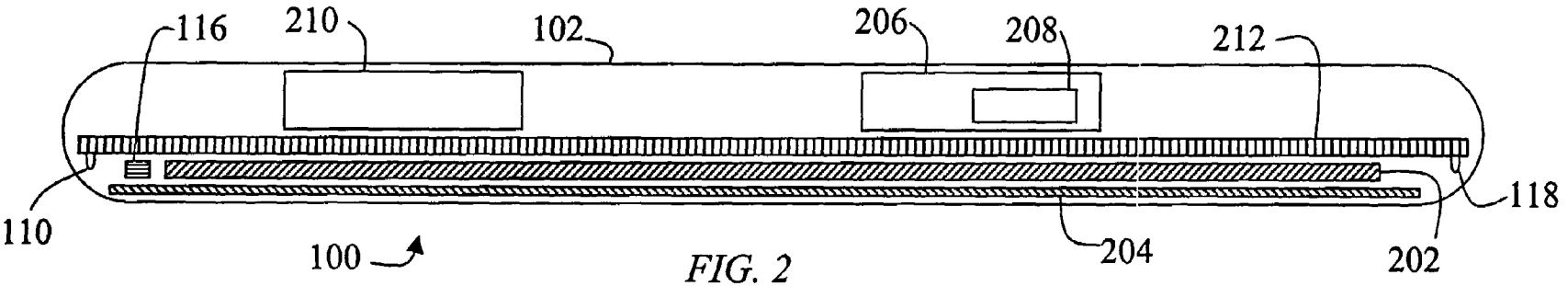
FIG. 2 is a top-view of the message sign alert device in accordance with an embodiment of the present invention.

In reference to FIG. 2, the message display section 108 includes a planar display unit 202 that has a plurality of light emitting message elements for displaying message information. The planar display unit 202 is contained within the housing 102 and is adjacent to the planar message display window 204. The planar display unit 202 can project light from the plurality of message elements through the planar message display window 204. The light from the planar display unit 202 is projected at an angle that is substantially normal to the planar message display window 204. Hence, it is desirable to draw the attention of an intended viewer, such as a bystander, by broadcasting an alert to both draw the attention of the intended viewer as well as to allow the intended viewer an opportunity to position themselves more directly in front of the planar message display window 204 in anticipation of having a better viewing angle for the impending or current message.

An audible alert section 206 includes at least one sound emitting element 208 for outputting an alert sound. A controller 210 receives inputs from the sensor section 116 and outputs control signals to the first visual alert section 104, the second visual alert section 106, the audible alert section 206, and the planar display unit 202. The controller 210 synchronizes the operation of the light and sound emitting elements and the planar display unit 202 to a program consisting of a predetermined set of instructions.

Figure 3:
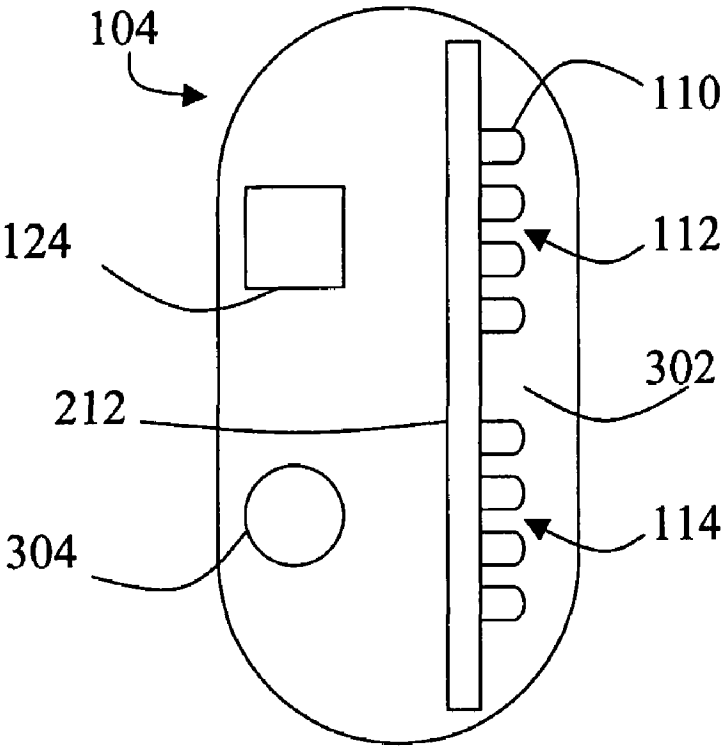
FIG. 3 is an end-view of the first visual alert section including a semi-transparent first visual alert window in accordance with an embodiment of the present invention.

In reference to FIG. 3, an end view of the first visual alert section 104 includes a printed circuit (PC) board 212 upon which are mounted the light emitting elements 110 in a first group 112 and a second group 114. The PC board 212 may be manufactured with a different technology, and serves to mount the plurality of light emitting elements 110 as well as to provide electrical connection to and between the various elements.

The first visual alert section 104 includes a semi-transparent first visual alert window 302 that is integrated with the housing 102. The semi-transparent cover 302 protects the end of the PC board 212 and the light emitting elements 110, but permits light to pass through from the light emitting elements 110 to the outside of the housing 102. The semi-transparent cover 302 includes port locations for mounting the terminal interface section 124 and a power interface section 304. The terminal interface section 124 allows connection to an external terminal device such as a personal computer. The power interface section 304 allows the connection of electrical power from a power supply unit to be discussed below.

The first visual alert window 302 includes an outer surface that is rounded in shape and extends in a continuous curve from the first plane around an edge on the periphery of the housing. Alternatively, the first visual alert window 302 may be polyhedral in shape, a solid shape bounded by polygons, having a plurality of polygonal face members. For example, the polygons can be triangle segments that are attached along their sides to form a piece-wise planar surface having a generally rounded appearance.

The polygonal shapes can provide a particular advantage in drawing the attention of a an individual passing in proximity to the message sign alert device through alternately attenuating and conducting light as a moving individual alternately enters and leaves a position parallel to the face of a particular polygonal face element. Alternatively, the polygonal shapes of the polyhedral sides can be square, pentagonal, hexagonal, or other polygonal shape.

Figure 4:
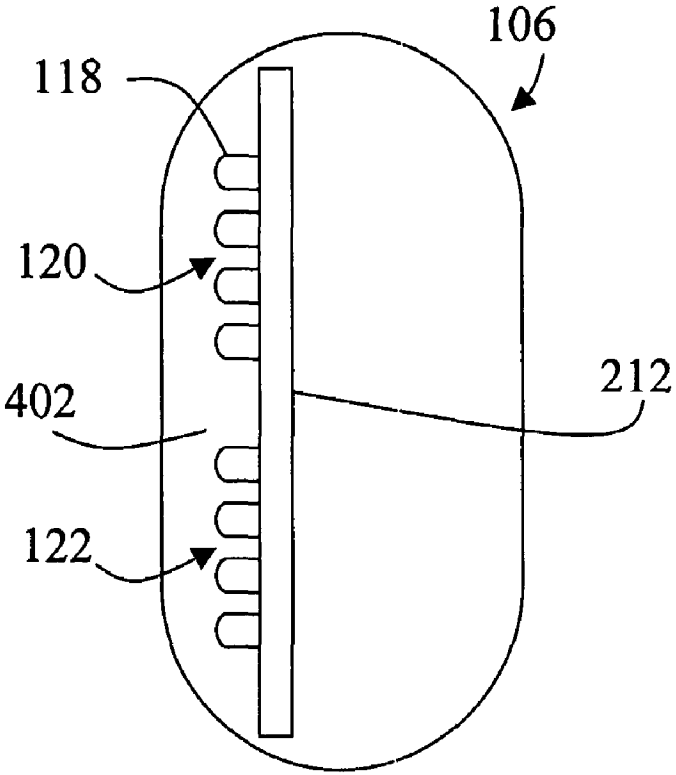
FIG. 4 is an end-view of the second visual alert section including a semi-transparent second visual alert window in accordance with an embodiment of the present invention.

In reference to FIG. 4, an end view of the second visual alert section 106 includes a PC board 212 upon which are mounted the light emitting elements 118 in a first group 120 and a second group 122. The second visual alert section 104 includes a semi-transparent second visual alert window 402 that is integrated with the housing 102. The semi-transparent cover 402 protects the end of the PC board 212 and the light emitting elements 118, but permits light to pass through from the light emitting elements 118 to the outside of the housing 102.

The second visual alert window 402 includes an outer surface that is preferably rounded in shape and extends in a continuous curve from the first plane around an edge on the periphery of the housing. Alternatively, the second visual alert window 402 may be polyhedral in shape, as discussed above. Although one PC board 212 is shown as a mounting platform for the cited components, any number of the internal components may be mounted either together or separately within the housing 102.

Figure 5:
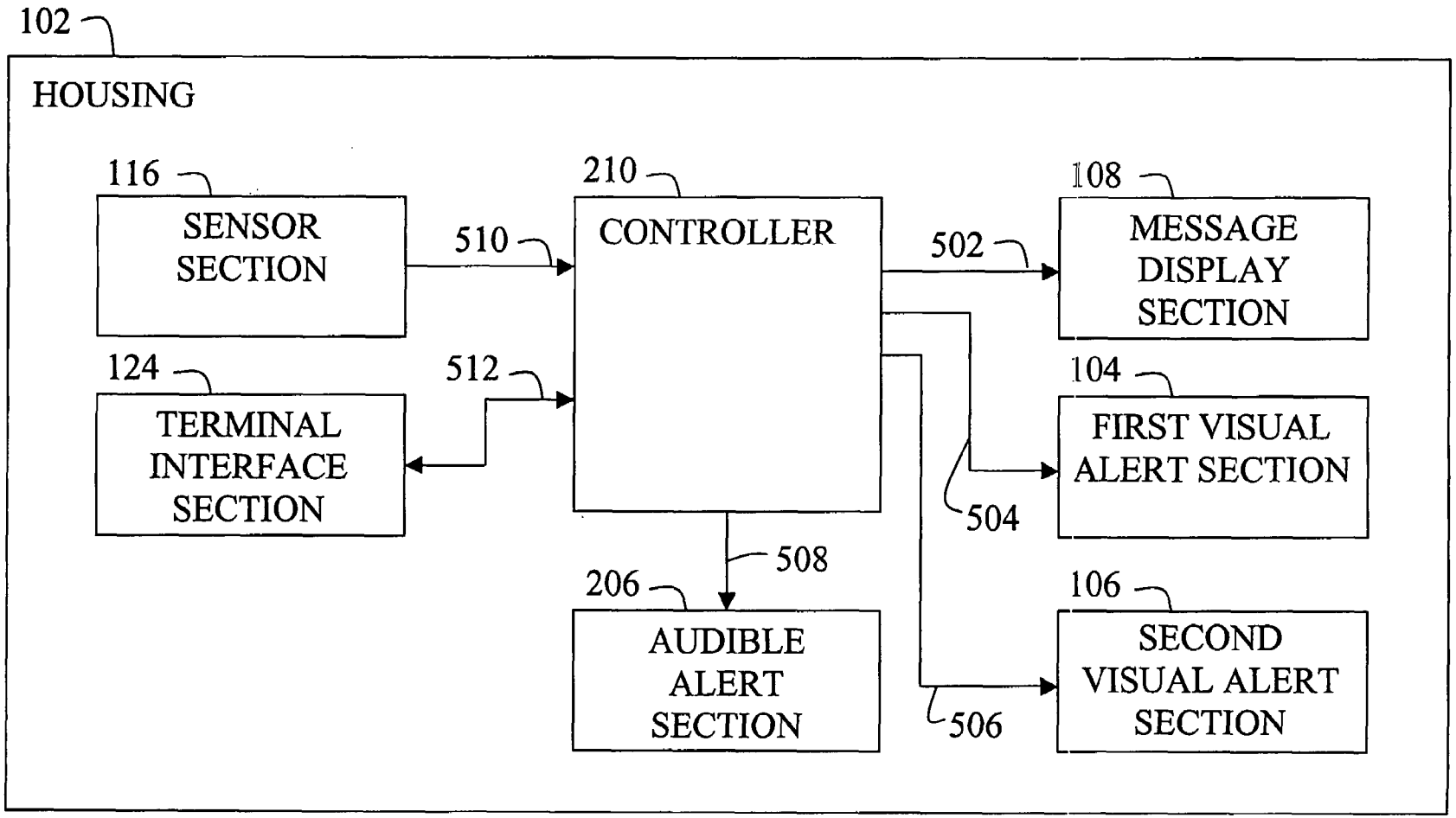
FIG. 5 is a block diagram showing a controller, message display section, first visual alert section, second visual alert section, audible alert section, sensor section, and terminal interface section within the housing in accordance with an embodiment of the present invention.

In reference to FIG. 5, a controller 210, a message display section 108, a first visual alert section 104, a second visual alert section 106, an audible alert section 206, a terminal interface section 124, and a sensor section 116 are included within the housing 102. The controller 210 outputs a message control signal 502 to control the display a message on the message display section 108. The message control signal 502 determines the indicia that will be reproduced on the message display section 108. The controller 210 outputs a first visual alert section control signal 504 to operate the first visual alert section 104.

Operation of the first visual alert section 104 includes lighting (turning on) and delighting (turning off) any of the plurality of light emitting first visual alert elements 110. The controller 210 outputs a second visual alert section control signal 504 to operate the second visual alert section 106. Similar to the first visual alert section 104, operation of the second visual alert section 106 includes lighting (turning on) and delighting (turning off) any of the plurality of the light emitting second visual alert elements 118.

The controller 210 outputs an audible alert section control signal 508 to operate the audible alert section 206. Operation of the audible alert section 510 includes sounding (turning on) and silencing (turning off) the sound emitting element 208. The controller 210 receives input from and provides status to an external terminal through the terminal interface section 124. The controller 210 receives configuration data and message data from a wireless remote unit through the sensor section 116. The sensor section 116 can include a photo-sensitive diode (not shown) for receiving wireless signals. The controller 210 is preferably implemented with a suitably programmed microprocessor that executes a sequence of instructions to perform the requested operations.

Figure 6:
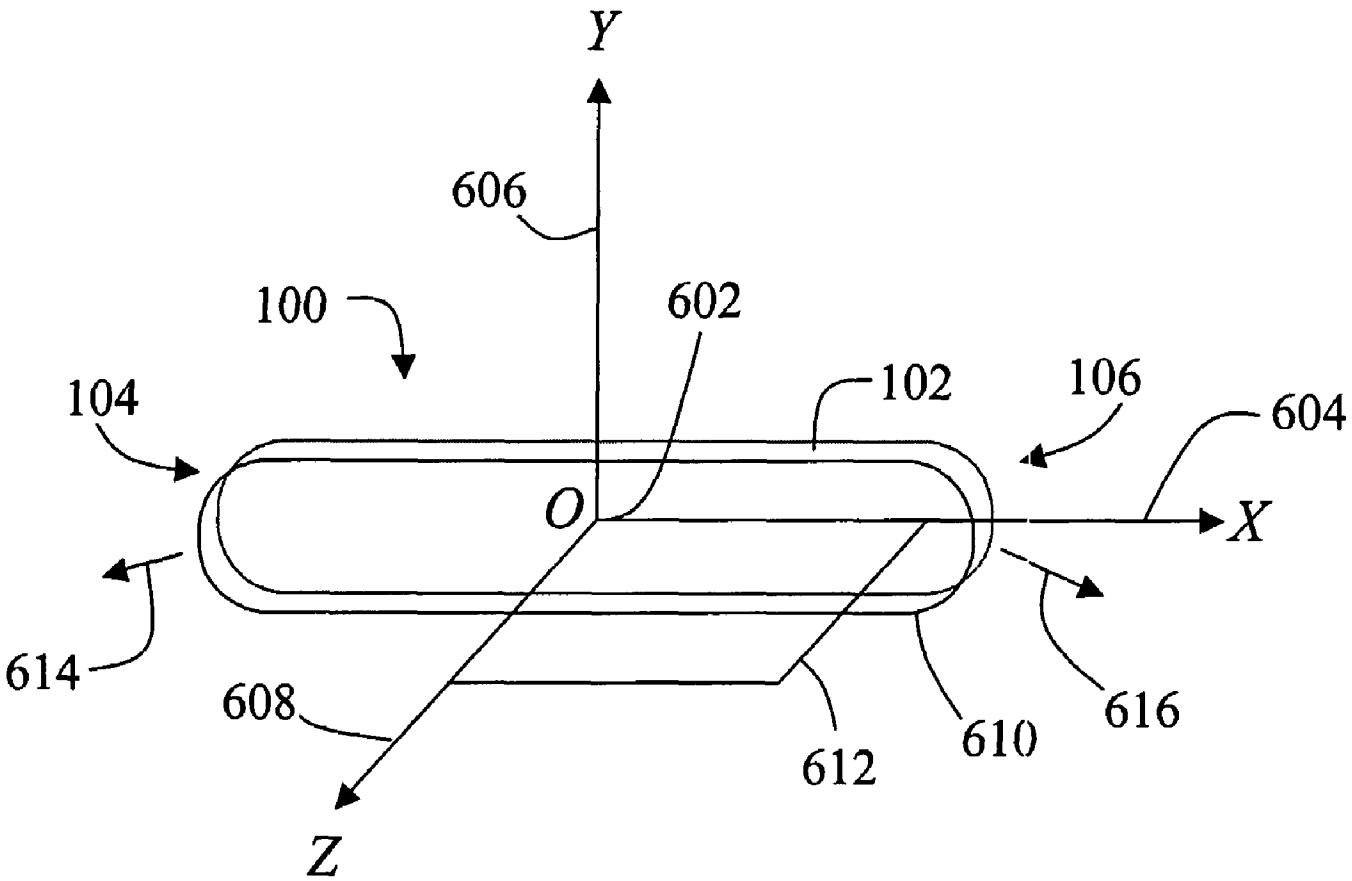
FIG. 6 shows a three-dimensional coordinate system in reference to the message sign alert device in accordance with an embodiment of the present invention.

In reference to FIG. 6, a three-dimensional coordinate system in reference to the manner in which light is emitted from the message sign alert device 100. For the purposes of this discussion, the message sign alert device 100 is oriented so that the Origin 602 of the three-dimensional coordinate system is centered within the message sign alert device 100. The housing 102 is preferably elongated along the X-axis 604 to accommodate the representation of various indicia, such as a partial line of text that can include both fixed and scrolling characters.

The housing 102 has a vertical height along the Y-axis 606. The housing 102 has a depth along the Z-axis 608. The message display window 204 is normal to the Z-axis 608 and is in a first plane 610 that is substantially parallel to the X-Y plane shown by the X-axis 604 and the Y-axis 606. A second plane 612 cuts through the center of the message display window 204 and is substantially parallel to the X-Z plane shown by the X-axis 604 and the Z-axis 608. The first visual alert section 104 projects light in a first direction 614 away from a first end of the housing 102. The second visual alert section 106 projects light in a second direction 616 away from a second end of the housing 102.

Figure 7:
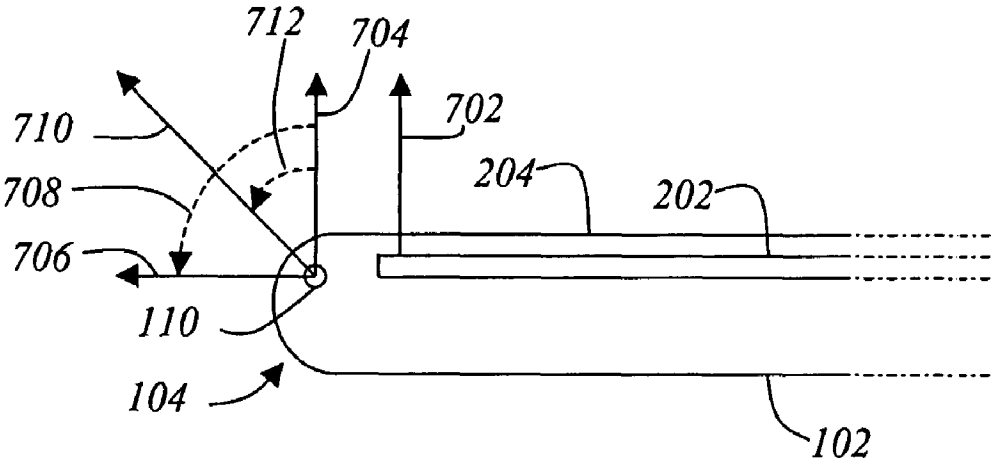
FIG. 7 shows a bottom-view of the first visual alert section including a first range of angles for the light emitting visual alert element in accordance with an embodiment of the present invention.

In reference to FIG. 7, a cross-sectional view of the first end of the housing 102 is shown indicating various angles corresponding to light emitted from a first visual alert section 104 light emitting alert element 110 into the second plane 612. It is understood that the light emitting element 110 radiates light in three-dimensions, but for this discussion, the oblique projection angle may be best understood by a two-dimensional description as follows. First, the light 702 from the planar display unit 202 is emitted to be substantially normal to the first plane 610.

The light emitting element 110 can emit light 704 that is parallel to the light 702, and can emit light 706 that is perpendicular at an angle 708 of about 90-degrees to the light 702. Thus, the light emitting element 110 can emit light through a first range of angles, having a wide field of view without obstructions, from the first visual alert section 104 at a first range of angles on the periphery of the message display window 204 in order to attract attention from the side of the message sign alert device 100.

The first range of angles described as to the side of the message sign may be considered as oblique angles defined as having a slanted or sloping direction, course or position. The first range of oblique angles has a central ray considered as the first central oblique angle 710 that corresponds to the center of the range of oblique angles. The first central oblique angle 710 is within the second plane 612 and is inclined in a first direction at an angle 712 of about 45-degrees away from the light 702 that is normal to the planar message display window. Light may be emitted in a first range of angles from the second visual alert section 106 in a similar manner.

Figure 8:
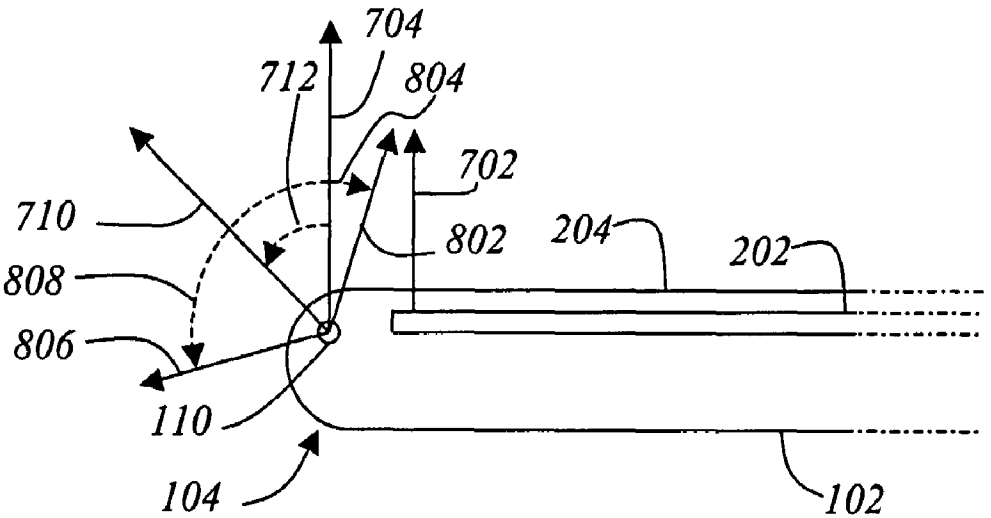
FIG. 8 shows a bottom-view of the first visual alert section including a second range of angles for the light emitting visual alert element in accordance with an embodiment of the present invention.

In another embodiment described in reference to FIG. 8, the light emitting element 110 can emit light through a second range of angles having an even wider field of view compared with the first range of angles. In this embodiment, light 802 is emitted within the second plane 612 at an angle 804 and in a second direction towards the center of the message display window 204. Light 806 is emitted at an angle 808 relative to the light 704 in a direction away from the center of the message display window 204. The central ray 710 may be located at a different angle than approximately 45-degrees away from the light 702.

Thus, the light emitting element 110 can emit light through a second range of angles, having a wide field of view without obstructions, from the first visual alert section 104 at a second range of angles on the periphery of the message display window 204 in order to attract attention from the side of the message sign alert device 100. Light may be emitted in a second range of angles from the second visual alert section 106 in a similar manner. Although this description includes the radiation angles within the second plane 612, it is understood that the light emitting elements 110 emit light in three-dimensions, and this description is intended to describe the side projection of light from the ends of the housing 102, and is not intended to be limited to only the second plane 612.

Figure 9:
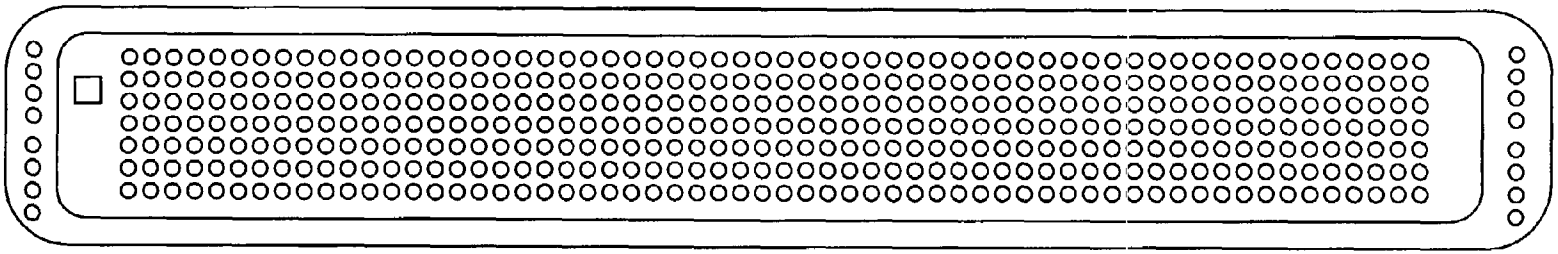
FIG. 9 shows a front-view of the message sign alert device when neither the visual alert sections nor the message display section are activated.

In reference to FIG. 9, a front view of the message sign alert device 100 is shown when neither the visual alert sections nor the message display section are activated. This state may exist during a power off condition, a power on condition when neither a message nor a visual alert are being displayed.

Figure 10:
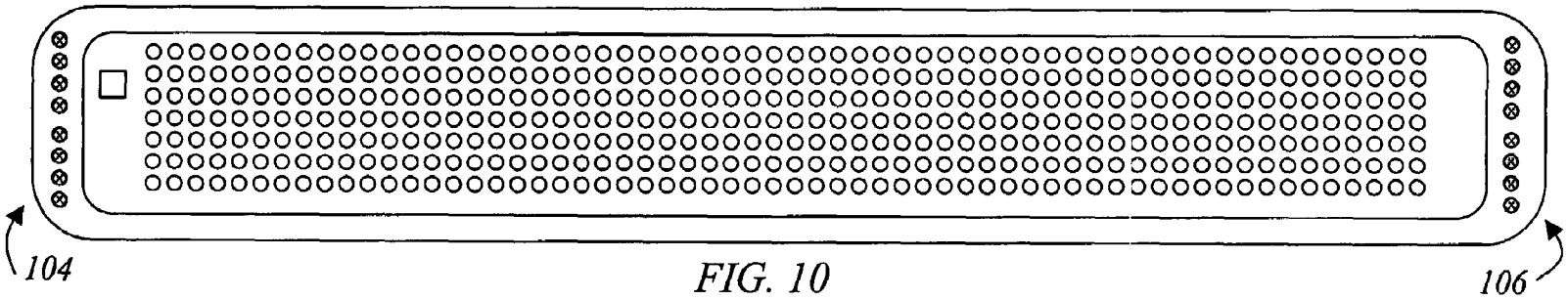
FIG. 10 shows a front-view of the message sign alert device when the visual alert sections are activated and the message display section is not activated.

In reference to FIG. 10, a front view of the message sign alert device 100 is shown when only the visual alert sections are activated. This state may exist prior to displaying a message so that attention will be drawn to a forthcoming message.

Figure 11:
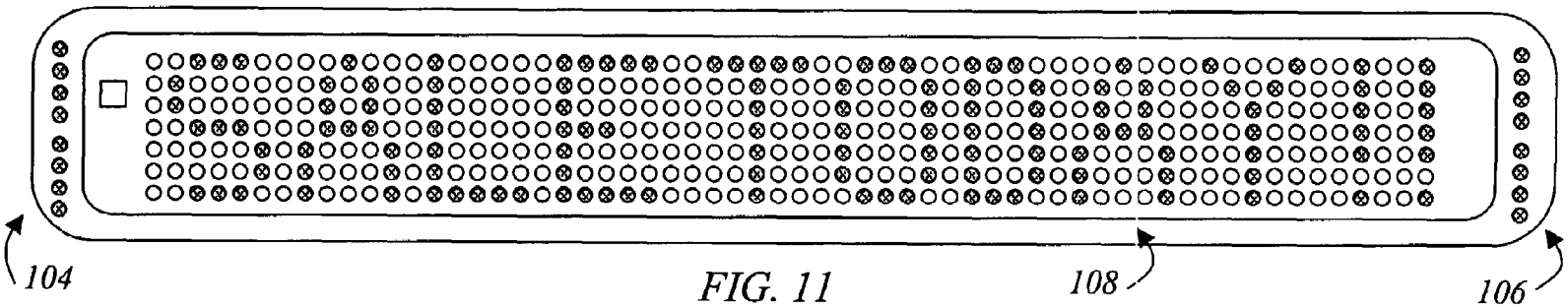
FIG. 11 shows a front-view of the message sign alert device when both the visual alert sections and the message display section are activated.

In reference to FIG. 11, a front view of the message sign alert device 100 is shown when both the visual alert sections and the message display section are activated. This state may exist during displaying a message so that attention will be drawn to the currently displayed message.

Figure 12:
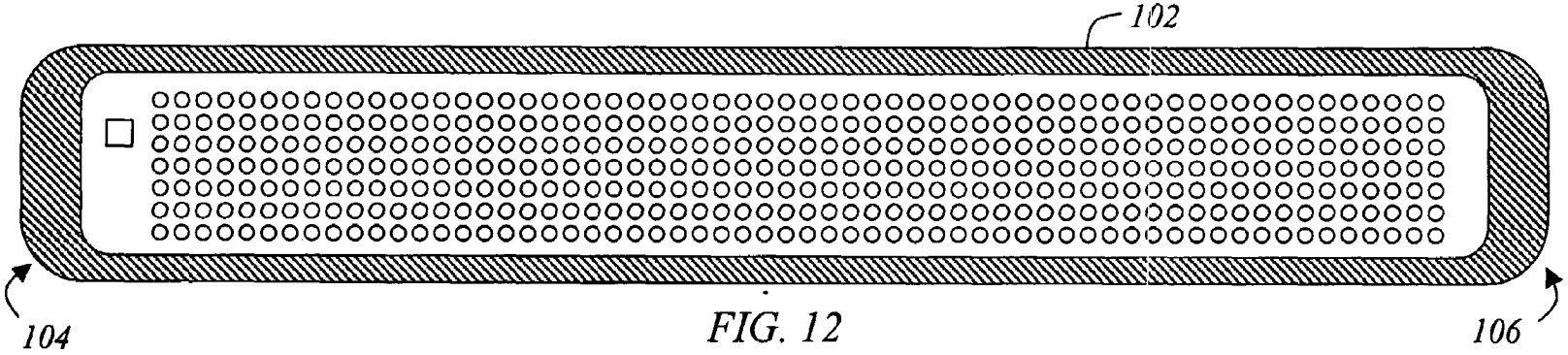
FIG. 12 shows a front-view of the message sign alert device where the housing presents a uniform, unitary appearance and the visual alert sections are not activated.
Figure 13:
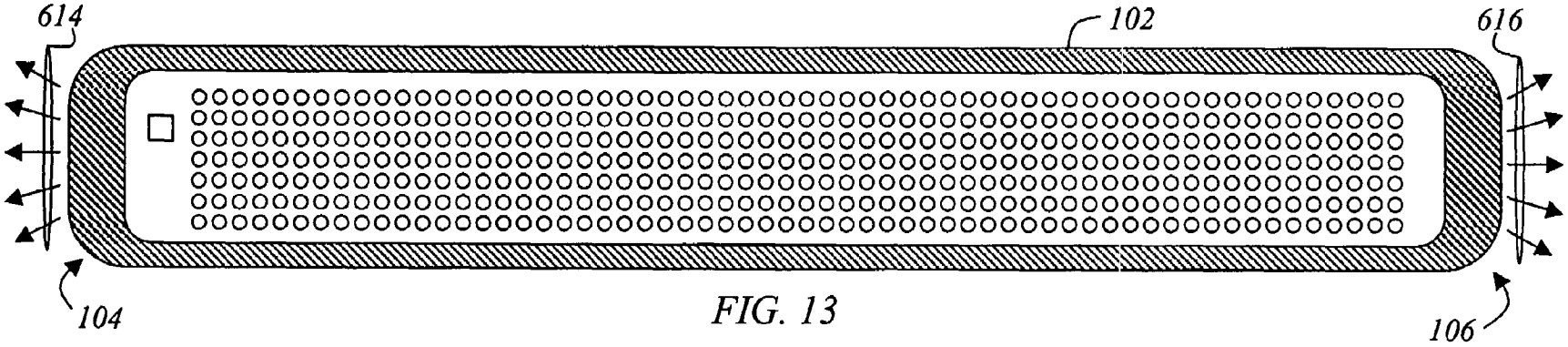
FIG. 13 shows a front view of the message sign alert device where the housing presents a uniform, unitary appearance and the visual alert sections are activated.

In reference to FIG. 12, the housing 102 presents a uniform, unitary appearance and the visual alert sections (104, 106) are not activated. In this case, the message sign alert device 100 may not obviously include visual alert elements since the visual alert windows (302, 402) preferably appear to be the same as the rest of the housing 102. However, in reference to FIG. 13, the housing 102 includes semi-transparent visual alert windows (302, 402) that allow light from the activated visual alert sections (104, 106) to project light outside the housing 102.

Figure 14:
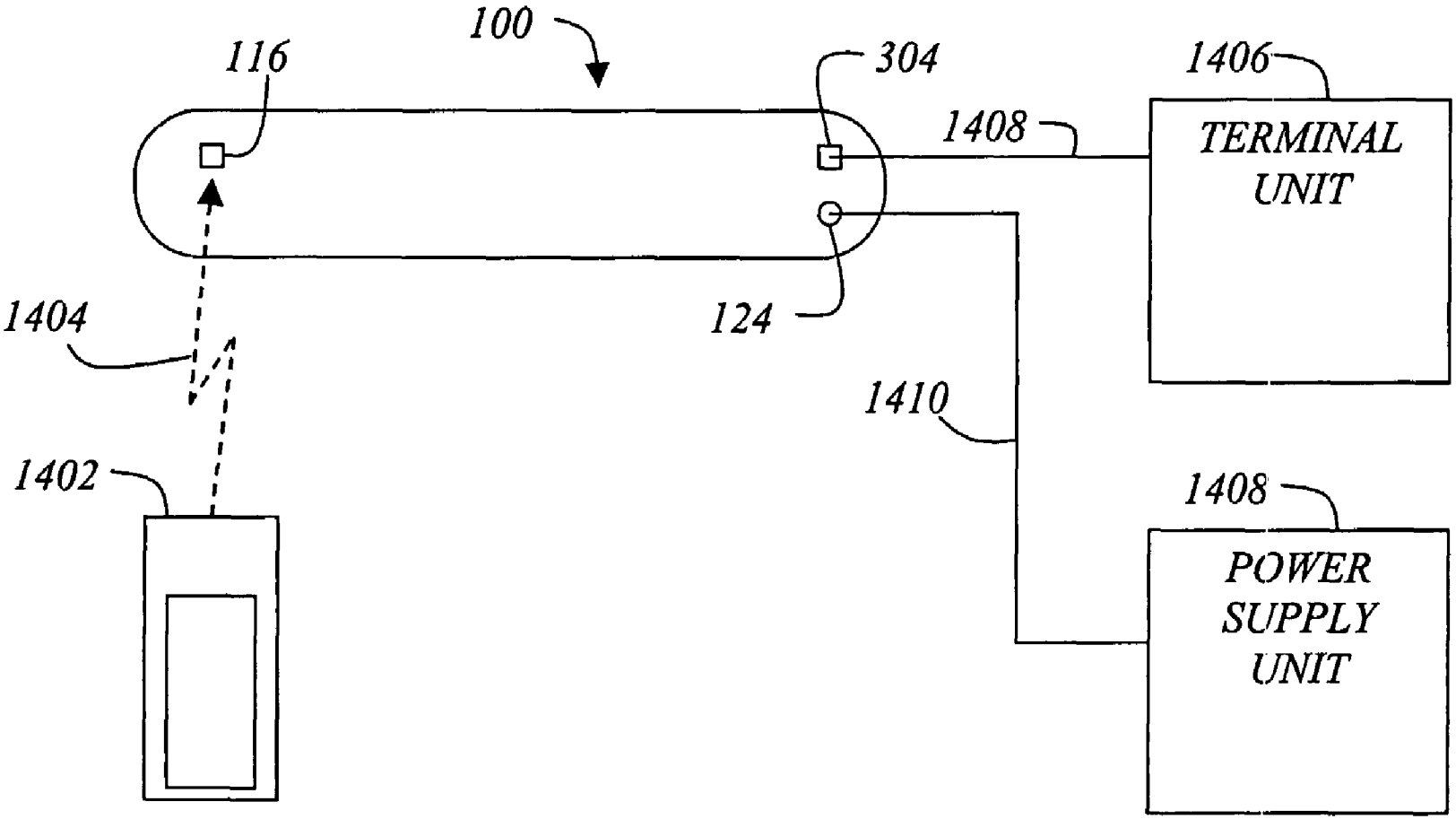
FIG. 14 shows a system view of the message sign alert device in wireless communication with a hand-held remote control unit, and wired communication with a terminal unit.

In reference to FIG. 14, a system view of the message sign alert device 100 includes a hand-held remote control unit 1402, a terminal unit 1406, and a power supply unit 1408. The hand-held remote control unit 1402 emits a wireless command signal 1404 that is received by the sensor section 116 and decoded into a user instruction by the controller 210. The terminal unit 1406 is connected with the message sign alert device 100 through a communication cable 1408 to the terminal interface section 124.

The communication cable 1408 can be a serial data communication cable using a protocol that conform to the recommended standard RS-232, for example. The terminal unit 1406 sends message data and configuration data to the controller 210. The hand-held remote control unit 1402 and the terminal unit 1406 can be used independently or together to load, modify, and unload message data and configuration data to the message sign alert device 100. The power supply unit 1408 supplies electrical power to the message sign alert device 100. Once the message sign alert device 100 is powered on and programmed, the terminal unit 1406 may be disconnected from the housing 102 as the sequence of message data is displayed and alerts asserted according to the configuration data are executed by the controller 210 according to the current instruction sequence running on the controller 210.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A message sign alert device, comprising:

a housing having a planar message display window in a first plane and a first visual alert window disposed on the housing at a periphery of the planar message display window;

a message display section having a planar display unit including a plurality of light emitting message elements for displaying message information, the planar display unit being disposed within the housing and adjacent to the planar message display window for projecting light from the message elements through the planar message display window, the light from the plurality of light emitting message elements being projected at an angle that is substantially normal to the planar message display window;

a first visual alert section having at least one light emitting first visual alert element disposed within the housing and adjacent to the first visual alert window for emitting a first visual alert signal through the first visual alert window, the light from the at least one first visual alert element being projected at an oblique angle relative to the planar message display window; and a control unit for operating the message display section and the first visual alert section, the control unit operating the first visual alert section to emit the first visual alert signal for operatively providing a visual attraction to the display of a message on the planar message display section.

2. The message sign alert device of claim 1, wherein the first visual alert signal is an alternating lighting and delighting of the at least one first alert element.

3. The message sign alert device of claim 1, further comprising:

an audible alert section having at least one sound emitting element disposed within the housing, the control unit operating the audible alert section to emit an audible alert signal from the housing for operatively providing an audible attraction to the display of a message on the message display section.

4. The message sign alert device of claim 3, wherein the audible alert is an alternating sounding and silence of the at least one sound emitting element.

5. The message sign alert device of claim 1, wherein the first visual alert section projects light in a first range of angles measured in reference to a second plane having as a central ray of the first range of angles a first central oblique angle that is inclined in a first direction away from an angle that is normal to the planar message display window, the second plane being normal to the first plane, the first direction being from a center line of the planar message display window towards the first visual alert section.

6. The message sign alert device of claim 5, wherein the first range of angles includes the range of approximately 0-degrees to approximately 120-degrees being measured from an angle that is normal to the planar message window.

7. The message sign alert device of claim 1, wherein the message display section is enabled to display indicia.

8. The message sign alert device of claim 7, wherein the indicia includes alphanumeric characters.

9. The message sign alert device of claim 1, wherein an outer surface of the first visual alert window on the housing is rounded in shape to extend in a continuous curve from the first plane around an edge of the housing.

10. The message sign alert device of claim 1, wherein an outer surface of the first visual alert window on the housing is polyhedral in shape having one side intersecting with the first plane.

11. The message sign alert device of claim 1, wherein the first visual alert window is semi-transparent and forms a portion of the housing.

12. The message sign alert devices of claim 11, wherein the first visual alert window includes a coloration to match a coloration of the housing.

13. The message sign alert device of claim 1, wherein the control unit operates the first visual alert section according to a programmed sequence, the programmed sequence including sequentially activating and deactivating the at least one light emitting first visual alert element to provide a flashing effect.

14. The message sign alert device of claim 1 further including a handheld remote control unit that emits a wireless command signal of user instructions and a wireless signal sensor section on the housing for receiving the wireless command signal and transmitting the wireless command signal to the control unit.

15. A message sign alert device, comprising:

a housing having a planar message display window in a first plane, a first visual alert window disposed on a periphery of the planar message window, and a second visual alert window disposed on the periphery of the planar message display window;

a message display section having a planar display unit including a plurality of light emitting message elements for displaying message information, the planar display unit being disposed within the housing and adjacent to the planar message display window for projecting light from the message elements through the planar message display window, the light from the plurality of light emitting message elements being projected at an angle that is substantially normal to the planar message display window;

a first visual alert section having at least one light emitting first visual alert element disposed within the housing and adjacent to the first visual alert window for emitting a first visual alert signal through the first visual alert window, the light from the at least one first visual alert element being projected at an oblique angle relative to the planar message display window;

a second visual alert section having at least one light emitting second visual alert element disposed within the housing and adjacent to the second visual alert window for projecting light from the at least one second visual alert element through the second visual alert window, the light from the at least one second visual alert element being projected at an oblique angle relative to the planar message display window; and a control unit for operating the message display section, the first visual alert section, and the second visual alert section, the control unit operating the first visual alert section and the second visual alert section to emit the first visual alert signal and the second visual alert signal for operatively providing a visual attraction to the display of a message on the message display section.

16. The message sign alert device of claim 15, further comprising:

an audible alert section having at least one sound emitting element disposed within the housing, the control unit operating the audible alert section to emit an audible alert signal for operatively providing an audible attraction to the display of a message on the message display section.

17. The message sign alert device of claim 16, wherein the control unit operates the first visual alert section, the second visual alert section, and the audible alert section simultaneously to produce an alternating lighting and sounding followed by a delighting and silence.

18. A message sign alert device, comprising:

a housing having a planar message display window in a first plane and a first visual alert window disposed on a periphery of the planar message display window;

a message display section having a planar display unit including a plurality of light emitting message elements for displaying message information, the planar display unit being disposed within the housing and adjacent to the planar message display window for projecting light from the message elements through the planar message display window, the light from the plurality of light emitting message elements being projected at an angle that is substantially normal to the planar message display window;

a first visual alert section having at least one light emitting first visual alert element disposed within the housing and adjacent to the first visual alert window for emitting a first visual alert signal through the first visual alert window, the light from the at least one first visual alert element being projected at an oblique angle relative to the planar message display window; and a control unit for operating the message display section and the first visual alert section, the control unit operating the first visual alert section to emit the first visual alert signal for operatively providing a visual attraction to the display of a message on the planar message display section, wherein the first visual alert section projects light in a first range of angles measured in reference to a second plane having as a central ray of the first range of angles a first central oblique angle that is inclined in a first direction away from an angle that is normal to the planar message display window, the second plane being normal to the first plane, the first direction being from a center line of the planar message display window towards the first visual alert section.

19. The message sign alert device of claim 18, further comprising:

a second visual alert window disposed on the periphery of the planar message display window; and a second visual alert section having at least one light emitting second visual alert element disposed within the housing and adjacent to the second visual alert window for projecting light from the at least one second visual alert element through the second visual alert window, the light from the at least one second visual alert element being projected at an oblique angle relative to the planar message display window, wherein the control unit operates the second visual alert section to emit the second visual alert signal for operatively providing a visual attraction to the display of a message on the message display section.

20. The message sign alert device of claim 19, wherein the second visual alert section projects light in a second range of angles measured in reference to the second plane having as a central ray of the first range of angles a second center oblique angle that is inclined in a second direction away from an angle that is normal to the planar message window, the second direction being from a center line of the planar message display window towards the second visual alert section.

21. The message alert device of claim 18, wherein the first range of angles includes a range of approximately 0-degrees to approximately 120-degrees measured from an angle that is normal to the planar message window.

* * * * *